US008246785B2

(12) United States Patent
Granger

(10) Patent No.: US 8,246,785 B2
(45) Date of Patent: Aug. 21, 2012

(54) SYSTEM FOR APPLYING LIQUID DE-DUSTING AGENTS TO FIBROUS PRODUCTS

(75) Inventor: Mark Allan Granger, Highlands Ranch, CO (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 13/349,406

(22) Filed: Jan. 12, 2012

(65) Prior Publication Data

US 2012/0103551 A1 May 3, 2012

Related U.S. Application Data

(62) Division of application No. 12/706,903, filed on Feb. 17, 2010, now Pat. No. 8,118,973.

(51) Int. Cl.
*D21H 11/00* (2006.01)

(52) U.S. Cl. ..... 162/265; 162/135

(58) Field of Classification Search ..... 162/265, 162/135; 427/196, 384, 385.5, 386
See application file for complete search history.

(56) References Cited

U.S. PATENT DOCUMENTS

| | | | | |
|---|---|---|---|---|
| 2,324,787 | A | | 7/1943 | Lundgren |
| 4,058,386 | A | | 11/1977 | Faulkner et al. |
| 4,134,242 | A | | 1/1979 | Musz et al. |
| RE30,192 | E | | 1/1980 | Faulkner et al. |
| 4,363,680 | A | * | 12/1982 | Buck et al. ..... 216/83 |
| 4,473,428 | A | | 9/1984 | Buck et al. |
| 5,271,970 | A | | 12/1993 | Gribbin et al. |
| 5,882,372 | A | | 3/1999 | Brown et al. |
| 5,910,458 | A | | 6/1999 | Beer et al. |
| 5,997,956 | A | | 12/1999 | Hunt et al. |
| 6,939,576 | B2 | | 9/2005 | Deshpande et al. |
| 7,090,028 | B2 | | 8/2006 | Adiga et al. |
| 7,129,619 | B2 | | 10/2006 | Yang et al. |
| 7,282,238 | B2 | | 10/2007 | Shanmugham et al. |
| 8,118,973 | B2 | | 2/2012 | Granger |
| 2008/0057687 | A1 | | 3/2008 | Hunt et al. |
| 2008/0283048 | A1 | | 11/2008 | Petersen |

* cited by examiner

*Primary Examiner* — Mark Halpern
(74) *Attorney, Agent, or Firm* — Robert D. Touslee

(57) ABSTRACT

A system and method for applying de-dusting agents to fibrous mats, webs, and/or blankets requiring a lower usage of the de-dusting agents, and producing fibrous products having improved dust suppression are disclosed. The dedusting agent or agents are first reduced to very fine particles or droplets and then, in an air suspension, are passed through the fibrous mat, web and/or blanket to deposit the very fine particles or droplets onto the surfaces of the fibers.

12 Claims, 6 Drawing Sheets

SYSTEM FOR APPLYING LIQUID DE-DUSTING AGENTS TO FIBROUS PRODUCTS

This application is a division of application Ser. No. 12/706,903, filed Feb. 17, 2010 now U.S. Pat. No. 8,118,973. This invention involves a system and method of applying de-dusting agents to dry or nearly dry fibrous mats, webs and blankets and the products produced by these methods.

BACKGROUND

Fibrous mats, webs and blankets can be made by spinning molten materials like glass, slag, rock and various thermoplastic polymers and copolymers and attenuating the fibers to a desired average or mean diameter with mechanical forces or by jet blasts of air and/or combustion gases. Such processes are disclosed in U.S. Pat. Nos. 4,058,386 and RE030192, the disclosures of which are incorporated herein by reference, and many patents on processes similar to these patents. It is also known to make glass fiber insulation by forming primary fibers and then attenuating the primary fibers into fine insulation fibers using jet blast attenuation as disclosed in U.S. Pat. No. 5,882,372, the disclosure incorporated herein by reference, and in patents covering similar processes. It is also known to produce mat or webs from molten material by passing the molten through orifices, with or without nozzle tips, to form primary fibers and then to attenuate the still soft fibers by mechanically pulling or pulling with one or more rapidly moving gaseous streams to the desired diameters followed by collecting the fibers, wet or dry, onto a moving permeable belt. Also, numerous other systems and methods are known for forming fibrous mats, webs and/or blankets such as those wet or dry systems/methods used to make various kinds of paper, carding and lapping, and inclined wire wet laid nonwoven mat forming. Regardless of the system and method for forming the fibrous mat, web and/or blanket, the products usually contain some portion of very short fibers, fiber chips and other dust which tends fly off of the mat, web and/or blanket products during packaging, un-packaging, further processing, and/or use.

Normally a de-dusting agent is applied to the fibers and attenuated fibers prior to, during or after an aqueous binder is sprayed or otherwise applied onto the fibers prior to collecting the wetted fibers onto a permeable moving belt to form a thin mat, fibrous web or thick fibrous blanket, to reduce the dusting of the fibrous product. The mat, web and/or blanket is then usually passed through an oven, sometimes while being compressed by platens or a moving belt, to dry the product and to cure any binder on the fibers and in the fibrous product. The use of one or more de-dusting agents, applied in coarse particles or coarse droplets to the fibers before collection into an insulation mass is old, e.g. see U.S. Pat. No. 4,134,242, the disclosure incorporated herein by reference.

Fibrous mats are also produced by a process known as dry laid or wet laid processes in which fibers dispersed in air or water are laid onto a moving permeable belt moving over one or more suction boxes to remove the air or water to form a fibrous web. An aqueous binder and de-dusting agents are then applied to the wet or dry fibrous web in conventional ways and, after removing any excess binder and water, the wet, bindered fibrous web is carried through an oven to dry remove the water and to cure the binder in the mat. Such processes are disclosed in (add wet and dry laid mat process patents).

The purpose of the de-dusting agents is to reduce the fly of short fibers and/or dust particles, from the finished product when handling the products during packaging, during opening a bag of compressed product like insulation batts and when installing the products or working with and/or further processing the fibrous products. While the de-dusting agents are effective when present in sufficient amounts, the presence of the de-dusting agents in or on the binder can reduce the effectiveness of the binder, cause more binder to be required to achieve the desired strength in the product. Also, some of the de-dusting agent is volatilized off by the hot air and heat used to increase the temperature of the fibrous product to drive off the water, to dry the product, and particularly due to the high temperature required to cure the binder in the product. A more effective and efficient way of applying the de-dusting oil to the fibrous products is needed.

SUMMARY

Applicant has discovered that if the de-dusting agent is applied to a fibrous product after it has been dried and any binder that may exist on the surface of the fibers in the product has been cured, less de-dusting agent is required, there is no adverse affects to the binder performance and less binder is sometimes required plus the lower amount of de-dusting agent is more effective in repressing the short fibers or dust making the finished fibrous product more user friendly and more desirable. The fibers used to make fibrous webs, mats or blankets vary in diameter and length depending upon the intended application as is well known in the art of fibrous products. In thermal insulation product webs, mats and blankets, the fiber is usually a staple product having various lengths and average fiber diameters usually below about 6 microns, more typically less than about 4 microns and even more typically less than about 3 microns. In mat products, having a thickness of less than about 50 mils, the length of the fibers are more precise varying from about 1/16 inch to about 3 inches long or longer. More typically the lengths of the fibers in the mat products are in the range of about 0.1 inch to about 1.5 inch long with 0.2 to 1.25 inch being the most used. The diameter of at least some of the fibers in mat products are substantially larger, sometimes up to 40 microns, more typically up to about 30 microns, even more typically up to about 23 microns and most often up to about 16 microns. Some fibrous mat, web and blanket products contain microfibers, very fine fibers, having average fiber diameters of less than about 2 microns, more typically less than about 1 micron and often less than about 0.6 micron. Such very fine fibers are in most thermal insulation products and are also used in mats, etc. to make filter products and products used for containment facers on laminates like gypsum wall board, foam insulation, and other similar products.

The system of the invention comprises conventional systems for making fibrous mats, webs and/or blankets plus a de-dusting application system comprising one or more atomizing liquid de-dusting agent spray nozzles or generators located above or below the hot or cooled dried and cured fibrous mat, web or blanket after exiting the drying/curing oven and one or more suction tubes or boxes located close to the side of the of the fibrous mat, web or blanket opposite the spray nozzles or generators, or close to a permeable chain or belt carrying the fibrous mat, web or blanket, optionally with one or more fans, to pull air suspended fine droplets of one or more de-dusting agents through the fibrous mat, web or blanket and onto the fibers therein. The air pulled through the mat, web or blanket can optionally be recycled back to the one or more atomizing nozzles and/or droplet generators to be used over and over to carry the fine de-dusting droplets through the moving fibrous mat, web and/or blanket to maximize the material efficiency of the de-dusting agent(s).

The atomizing nozzle system(s) or droplet generators convert the liquid de-dusting agent(s) to droplets having a diameter of less than about 3 microns to sub-micron or nano droplets and when such droplets strike the fibers, the de-dusting agent droplets spread out onto the fibers. More typically the majority of the droplets are less than 2 microns or less than 1 micron in diameter and are most effective when the mean diameter is in the range of less than or equal to about 200 nanometers (nm) to as large as about 700-900 nm. Any device for creating droplets of the sizes disclosed above is suitable for use in the system and method of the invention, e.g. a suitable device is a piezoelectric ultrasonic atomizer.

The invention also includes a method of making of a fibrous mat, web and/or blanket comprising;

a) forming a fibrous mat, web or blanket from fibers made by attenuating a molten material, the fibers having water on their surfaces, b) passing the fibrous mat, web or blanket through an oven to remove the water and dry the fibrous mat, web or blanket, c) after removing the water and curing any binder from the fibrous mat, web or blanket, passing a gaseous suspension of liquid droplets of one or more de-dusting agents having mean diameters of less than about 3 microns into and at least mostly through the thickness of the mat, web and/or blanket by applying suction to a face of the fibrous mat, web or blanket, the face being different than a face that said gaseous suspension entered the mat, web and/or blanket. Normally the mat, web and/or blanket will be moving, and optionally the suction can be applied with a fan. Also, optionally, the outlet of the fan can communicate with the droplets coming from one or more atomizing nozzles or droplet generators such that at least most of the gas carrying the droplets into and at least mostly through the mat, web and/or blanket is recycled continuously through untreated portions of the moving mat, web and/or blanket insulation.

Suitable de-dusting agents used in the invention include known de-dusting silicone compounds and/or oils, hydrocarbon oils, vegetable oils, and other known organic fluids used in the fiber industry as de-dusting agents, with hydrocarbon oils and vegetable oils being possibly the most effective, especially when added in amounts of about 0.3 wt. % to about 2.2 wt. %, based on the dry weight of the fibrous mat, web or blanket prior to the addition of the de-dusting agent(s). More details on the de-dusting agents used in the invention are found below.

Some advantages of the systems and methods of the invention include:

1) Reduced usage of de-dusting agent(s) per unit of product since none of the de-dusting agent(s) will be volatilized off due to hot fibers in the forming chamber or hot gases in the drying and curing oven.

2) Condensation of de-dusting agent(s) in the oven recirculation ducts and exhaust ducts are eliminated along with frequent fires that result therefrom. These fires present a safety hazard to the operators and are very costly due to lost production, scrap, and fire damage. Also, each fire presents a potential larger fire if it spreads to the roof or other parts of the plant before it can be obtained.

3) Condensation of de-dusting agent(s) on the cooling table is eliminated.

4) The need for high temperature flash point de-dusting agents (to reduce fires in the ducts) is eliminated and better performing and/or lower cost de-dusting agents can now be used.

5) Reduced oven emissions.

6) A self lubricating collection and oven belt, chain can now be used eliminating the need for hydrocarbon lubricating oils that volatilize at high temperature and condense in the oven ducts causing further fire hazards.

When the word "about" is used herein it is meant that the amount or condition it modifies can vary some beyond that stated so long as the advantages of the invention are realized. Practically, there is rarely the time or resources available to very precisely determine the limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors' disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term "about" as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILED DESCRIPTION OF SOME EMBODIMENTS AND THE BEST MODE

Figure 1:
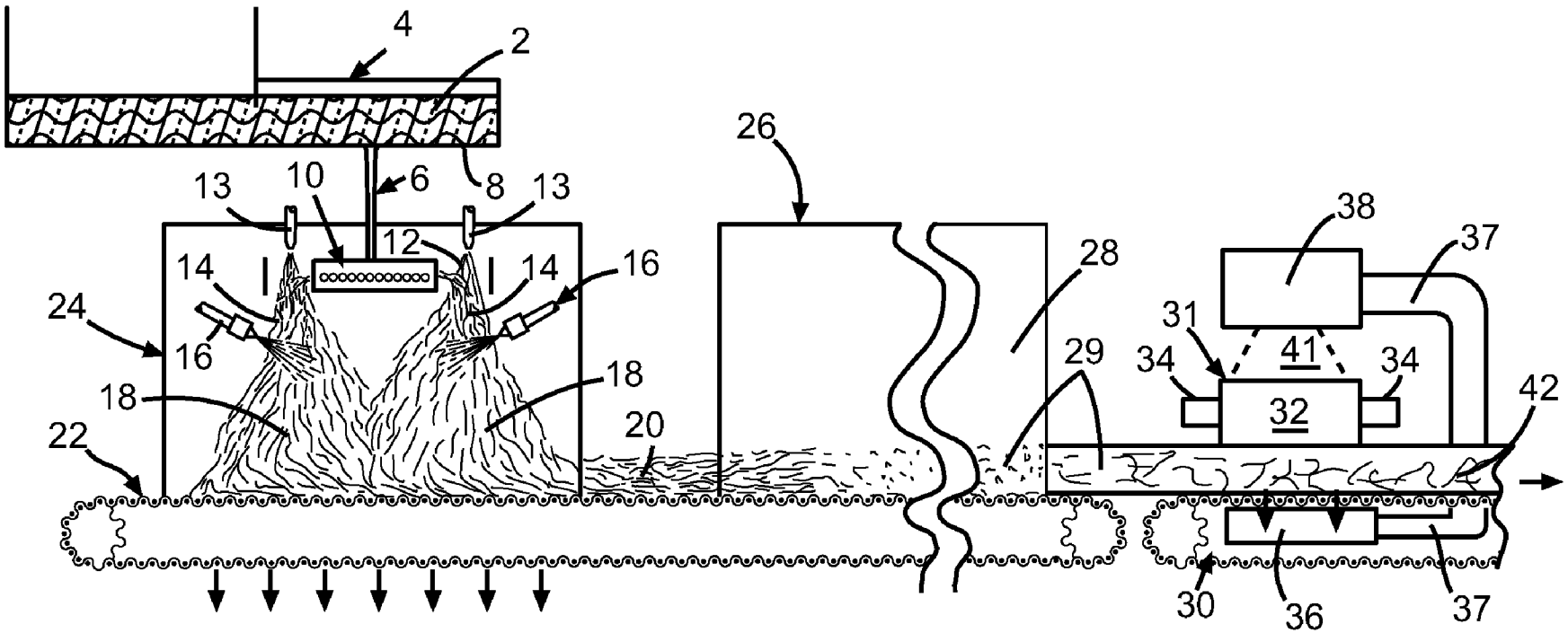
FIG. 1 shows a typical system for making a fibrous insulation according to the invention.

FIG. 1 shows a typical system of the invention used to make fibrous insulation, such as fibrous glass insulation, according to the method of the invention. A molten material 2, such as glass, slag, polymer(s), rock, and/or ceramic, is melted in any suitable furnace 4 for melting such materials. One or more streams 6 flows from one or more conventional orifice(s) (not shown) in the bottom 8 of the melting furnace 4 and each molten stream 6 falls into a rapidly rotating refractory metal spinner 10 having a plurality of spaced apart holes in a vertical wall of the spinner 10. Small diameter molten streams 12 emerge continuously from the spaced apart holes in the vertical wall of the spinner 10 and form primary fibers that are immediately turned downward and attenuated into very small diameter fibers 14 by high velocity jets of air, steam, or combustion gases coming from a plurality of nozzles 13, or a continuous slot of a manifold, located above the spinner 10 and outside the vertical wall.

The very small diameter, e.g. having a mean diameter of less than about 6 microns, typically less than about 4 microns and more typically less than about 2-3 microns, are then further cooled and optionally, but typically coated with a liquid binder with one or more spray nozzles 16. In prior art systems and processes, de-dusting agent would either be included in the liquid binder or would be sprayed onto the very small diameter fibers 14 separately, usually after the liquid binder was applied, but in the system and method of the invention, the de-dusting agent(s) are applied much later in the system and process.

The very small diameter fibers 18 are collected to form a web or blanket 20 on a moving permeable belt or chain 22, usually with the aid of a conventional suction fan (not shown) pulling air from a forming chamber 24, containing the very small diameter fibers 14 and fiber treating equipment. The nonwoven fibrous web or blanket 20 is carried out of the forming chamber 24 and into a drying oven 26. The oven 26, in a downstream end 28, after the water or other cooling liquid has been removed, can reach a sufficient temperature to also cure any binder that is present in the dried fibrous web or blanket 29.

The dried fibrous web or blanket is then carried on the same permeable belt 22, or more typically, transferred onto a second permeable belt 30 or carried on a roller conveyor and carried, through the de-dusting application system 31 of the invention. The de-dusting system 31 comprises an atomization chamber 32, an air suspension of particles or droplets generator, containing one or more atomizing nozzles or atomizers 34 that convert the one or more de-dusting agents into very fine droplets of the size described in the Summary above and producing an air suspension of the droplets 33 (see FIG. 5), or particles, in the atomization chamber 32. Below the second carrier belt 30 (or optionally 22) is a partial vacuum chamber 36 open to the bottom of the top flight of the permeable belt 30 (or optionally 22) to pull the air suspension of very fine droplets of de-dusting agent(s) into and throughout the fibrous web or blanket 29. The partial vacuum in the partial vacuum chamber 36 is maintained with a suction fan 38 connected to the partial vacuum chamber 36, typically with a duct 37. One or more additional ducts 37 can be used to enhance uniformity of the partial vacuum attracting the air suspension of particles or droplets generated in the atomization chamber 32, i.e. the air suspension generator. Most or many of the very fine droplets of de-dusting agent(s) strike fiber surfaces and spread out to form a coating on the fiber surfaces, but some droplets might or do still exist in the air coming through the top flight of the permeable belt 30 and into the partial vacuum chamber 36. The exhaust 37 from the suction fan 38 can be dumped into an conventional environmental unit such as a fume incinerator (not shown), or more typically can optionally be recycled into the atomization chamber 32, such as by connecting the output of the fan directly to the atomization chamber 32 or by connecting the output of the fan 38 to the atomization chamber 32 with a hood 41. The web or blanket 42 containing the desired amount of one or more de-dusting agents is now ready for conventional trimming and/or packaging.

While FIG. 1 shows the de-dusting agent particles or droplets being pulled into the fibrous web from the top face, which is the typical method, it should be realized that de-dusting agent(s) could be pulled into any face and throughout the fibrous web, mat or blanket by creating a partial vacuum or reduced pressure on any other face, normally an opposite face. Also, instead of pulling the air suspended particles or droplets of de-dusting agent(s) using a partial vacuum or reduced pressure, the air suspension can be pressurized to above ambient pressure using a fan or compressor to force the air suspension into the fibrous web, mat or blanket without the aid of a partial vacuum on another face. These modifications to the system and methods of the invention are applicable on any permeable fibrous mat, web and blanket including those shown in FIGS. 2 and 3.

Figure 2:
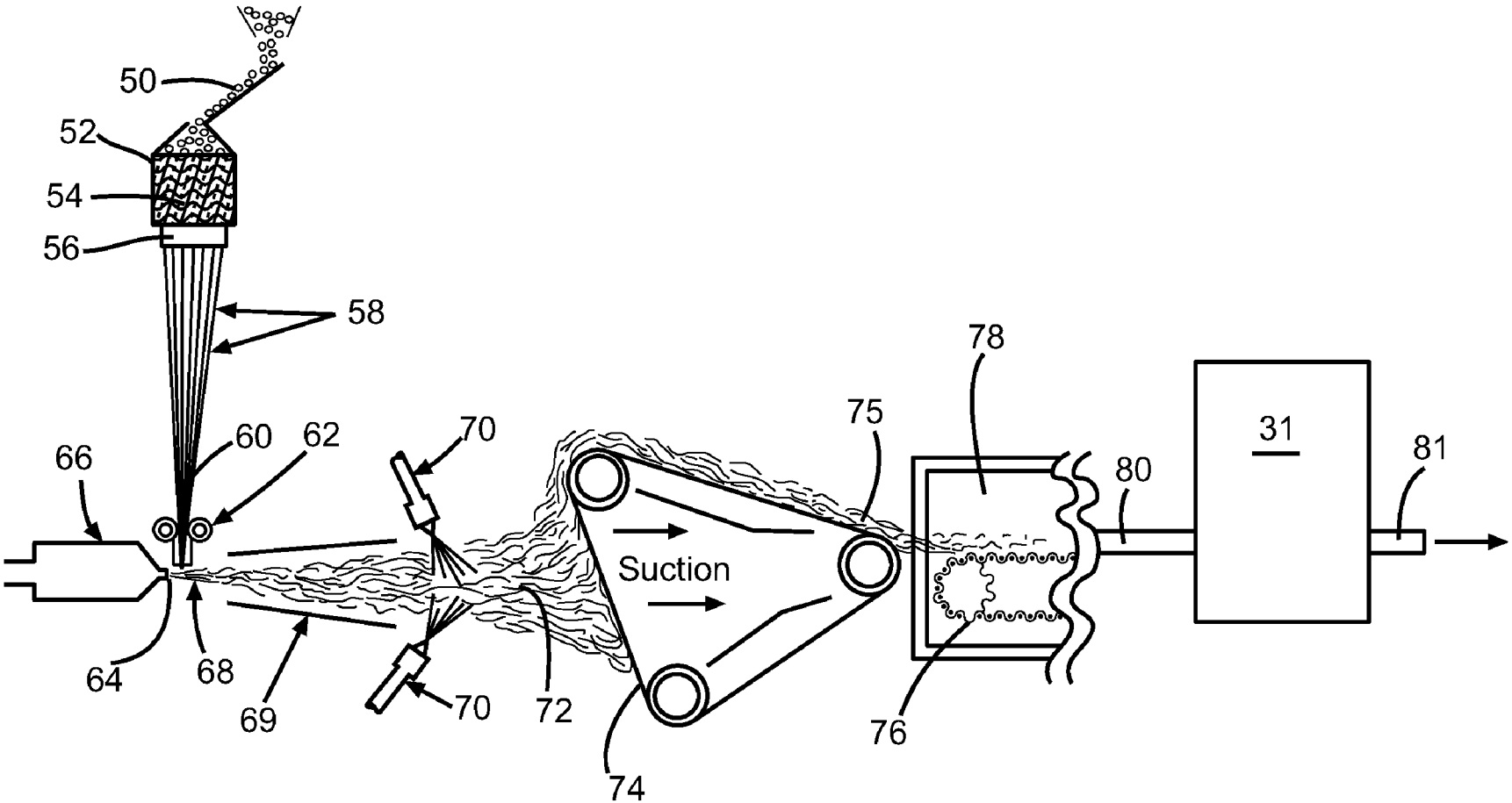
FIG. 2 shows another typical system for making a fibrous insulation according to the invention.

How the fibers are made is not critical to the system and method of the invention. For example, FIG. 2 shows another conventional system of making insulation fibers for making insulation webs and blankets. In this system, glass marbles 50 are fed to a melter 52 where the marbles 50 are melted and the melt 54 is brought to a fiberizing temperature in a bushing 56 having a plurality of orifices in a bottom plate. The molten glass flows through the plurality of orifices to form an array of primary fibers 58 and cooled to form solidified primary fibers 60. The solidified primary fibers 60 are pulled by a set of pull rolls 62 and fed into a hot jet blast 64 exiting a pressurized jet burner 66. The hot jet blast 64 re-melts the solidified primary fibers 60 and attenuates them into insulation fibers 68 having average mean diameter within a forming tube 69. The insulation fibers 68, while they are suspended in an air flow from the jet burner 66 and inspirated outside air are sprayed with water for cooling with nozzles 70, the water usually also containing a binder. In prior art processes of this type it was conventional to also apply the de-dusting agent in this same manner, normally after the binder was applied, but that is not done in the system and method of the invention.

The cooled fibers 72 are then collected into a web or blanket 75 on a moving, permeable belt 74 and carried onto another permeable belt, chain belt or platen belt and carried through a dryer 78 where water is removed and any binder in the web or blanket 75 is cured to form a fibrous web or blanket 80 that is then fed through the de-dusting system 31 of the invention to form an insulation product 81 containing the desired amount of one or more de-dusting agents that is ready for conventional trimming and/or packaging.

Figure 3:
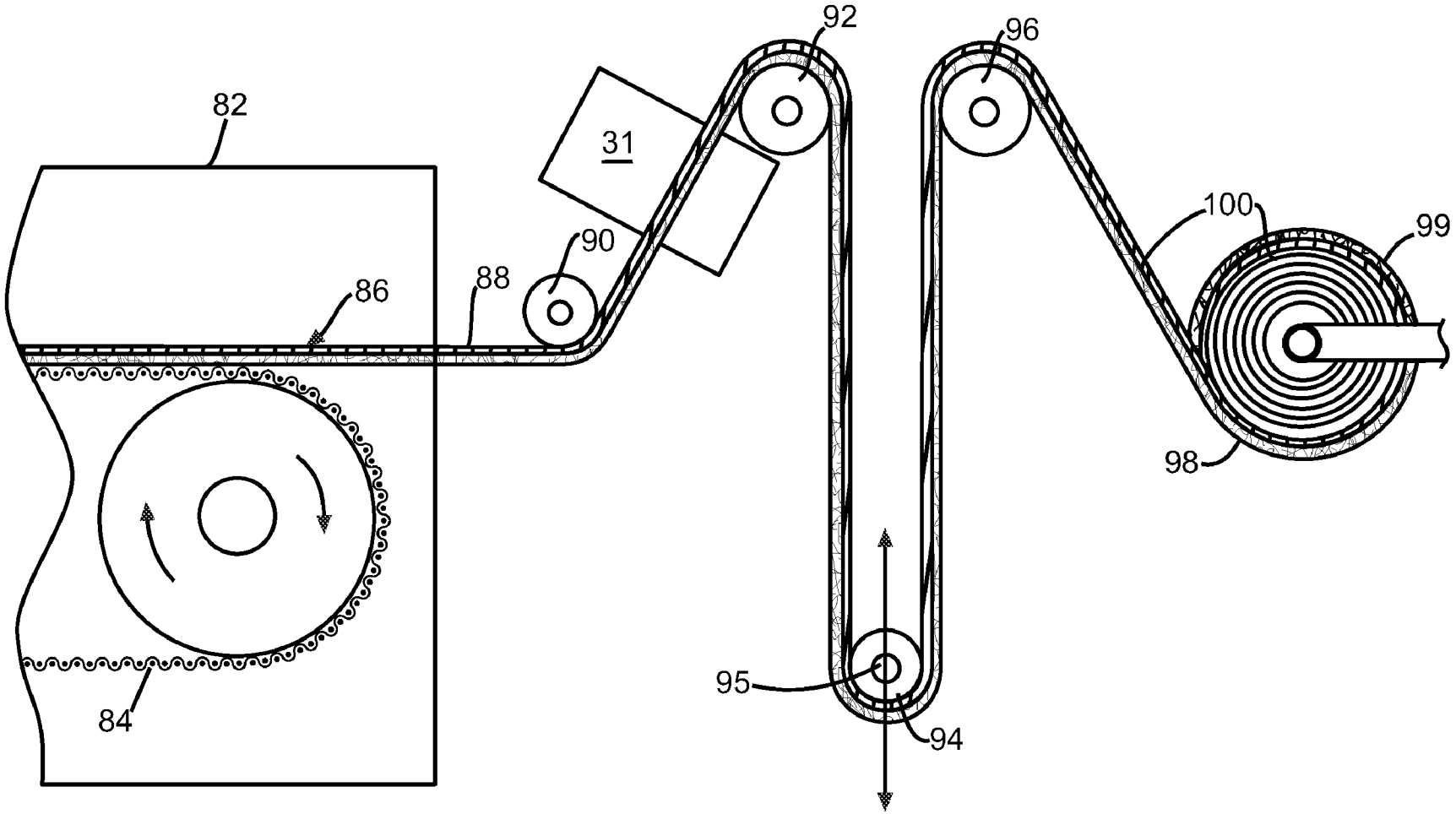
FIG. 3 shows a typical system for treating a fibrous web to make a mat.

FIG. 3 shows the down stream end of a mat forming system, modified according to the invention. A mat 86 has been formed upstream in either a conventional dry forming system/process or a conventional wet laid system/process. Conventional dry forming systems and processes include those shown in U.S. Pat. Nos. 4,666,647, 5,306,453, 6,306,539, 6,982,052 and 7,491,354, the disclosures of which are incorporated herein by reference, and conventional carding and lapping of fibrous webs. Conventional wet forming systems and processes include those shown in U.S. Pat. Nos. 4,112, 174, 4,973,382, 6,187,697 and 6,749,720, the disclosures of which are incorporated herein by reference, and conventional fibrous paper and fibrous felt forming systems and processes. The fibrous mats can contain a binder, but not necessarily. The wet mats are dried, and the binder if present is cured, while being carried through an oven 82 on a permeable belt 84. Dry mat 88 is pulled from the oven 82 by a powered mandrel 98, supported on arms 99 that winds finished mat 100 into a roll.

The dry mat 88 is turned upwardly, or can be turned downwardly, by a roll 90 and moved in tension towards a second turning roll 92 and through the de-dusting agent application system 31 of the invention to form the finished fibrous mat 100. A conventional take-up roll 94 mounted on a vertical movable shaft 95 again turns the finished fibrous mat 100 180 degrees towards a final turning roll 96. The fibrous mat 88 and the finished fibrous mat 100 is maintained in slight tension throughout the de-dusting agent application, take-up and winding portion of the system.

Figure 4:
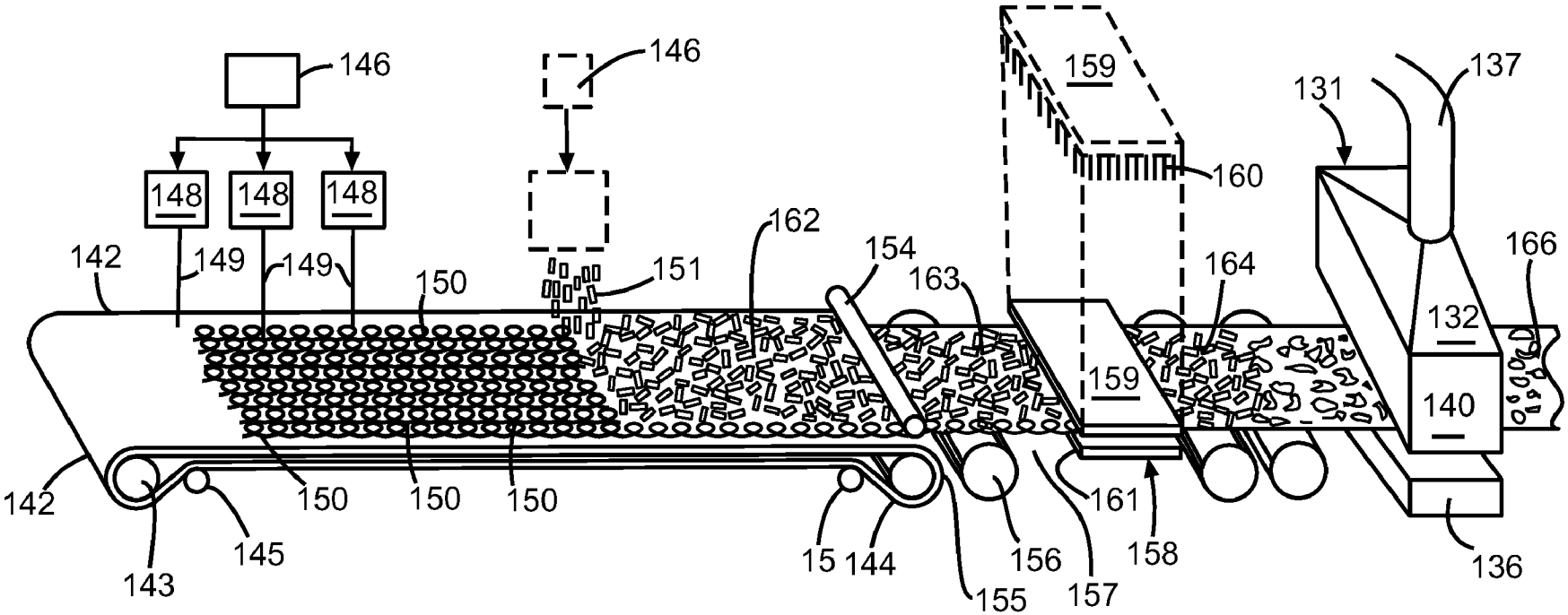
FIG. 4 shows another typical system for treating a fibrous needled web to make a mat, web, or thinner blanket.

Fibrous mats, webs and thinner blankets are often made in several different processes, all using needling to intertwine the fibers together to provide bonding in the product without using binder, or with the use of a much smaller amount of binder. The needling breaks some of the fibers and creates short fibers and chips and/or particles, i.e. dust. FIG. 4 is a perspective view of such a system for laying down a fibrous mat or web or thinner blanket from dry staple fibers or chopped fibers or fiber strands and optionally continuous fiber strands. In this system the mat, web or thinner blanket is built up on a moving conveyor belt 142 having a freely rotating head shaft 143, a driven tail shaft 144 and one or more take-up shafts 145. Continuous fiber rovings 149 can optionally be laid down first onto the moving belt 142 using a plurality of conventional roving applicators 148 supplied with one or more roving packages 146. The rovings can be of any type including various types of direct wound rovings having a single fiber strand and/or manufactured rovings having multiple fiber strands. The applicators can lay the rovings 149 down onto the moving conveyor belt 142 in any desired pattern including parallel strands or in loops as shown. The thickness of the rovings layer can be controlled by varying the speed of the conveyor belt 142, by adding one or more rows of applicators 148 or by any combination of these.

Next, chopped fibers or chopped strands, each chopped strand containing a plurality of fibers, are randomly dropped onto the moving rovings 150. Again, one or more roving packages 146 feed one or a plurality of roving strands 152 into a conventional fiber strand chopper 153 that separates the roving strands into pieces of desired length, usually a length in the range of about 12 to about 75 mm long. The thickness of the chopped fiber or chopped fiber strand layer can be varied by varying the speed of the conveyor belt 142, by adding multiple choppers or any combination of these. When formation of the web, mat or thinner blanket is complete, one or more consolidating rollers 154 compresses the web, mat or blanket 162 sufficiently that the consolidated web will stay together across a gap 155 between the tail end of the conveyor belt 142 and a supporting roller 156. Another optional consolidating roller (not shown) like the roller 154 can be mounted above the supporting roller 156 to further strengthen the consolidated web 163, etc. to span another gap 157 between the supporting roller 156 and a conventional needling machine 158. The needling machine 158 comprises an upper needle board 159 comprising a plurality of conventional barbed needles 160 and a lower needle board 161, also containing a plurality of barbed needles 160. In a conventional manner, the upper needle board 159 and the lower needle board 161 oscillate up and down to cause the needles 160 to penetrate the consolidated web 163 to push fibers down through the web on the penetrating strokes and then on the withdrawal strokes the barbs on the needles 160 pull different fibers in an opposite direction in the web to cause densification of the web and intertwining and locking of the fibers as is well known. When the needle boards and needles are withdrawn from the web, the consolidated mat is pulled, with a down stream puller (not shown) an incremental distance for the next needling stroke. In this manner a needled web, mat or thinner blanket 164 is produced. According to the invention, this needled fibrous web, mat or thinner blanket is pulled through the de-dusting application system 131, same as 31 in FIG. 1, to apply one or more de-dusting agents to control the dust in the needled product 164 to produce a finished needled web, mat or thinner blanket product 166.

The fibrous mats 164 are made of one or more of a wide variety of fibers including natural fibers, synthetic polymer fibers, ceramic fibers glass fibers, carbon fibers and any combination thereof. The diameter of the fibers are not critical, but usually have mean or average fiber diameters of less than about 30 microns, normally less than about 23 microns, typically less than about 17 microns including less than 6 microns, and for thermal insulation and filtration mats, less than about 3 microns including submicron average or mean diameters.

Figure 5:
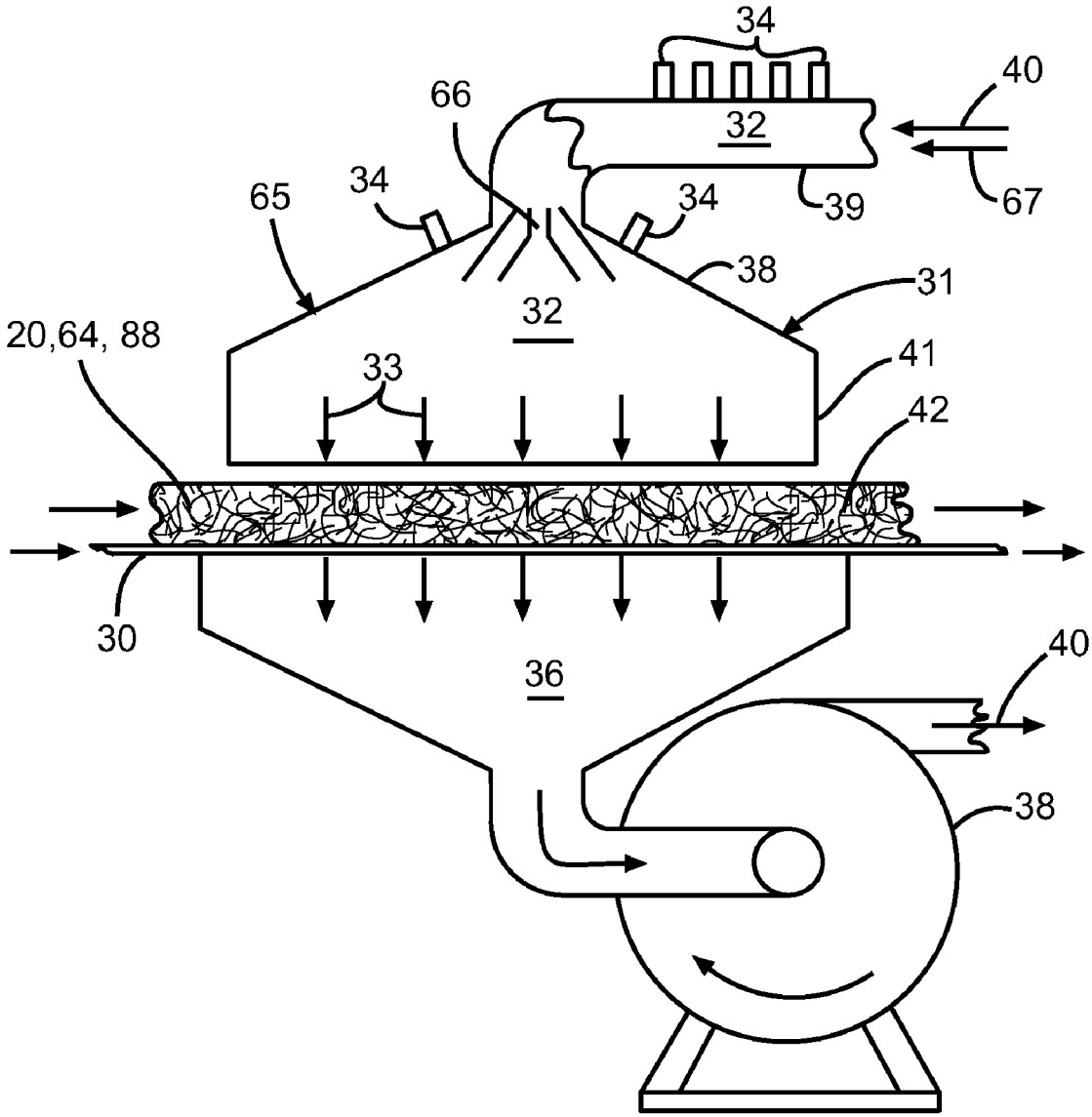
FIG. 5 is a front view the de-dusting agent application system of the invention.
Figure 6:
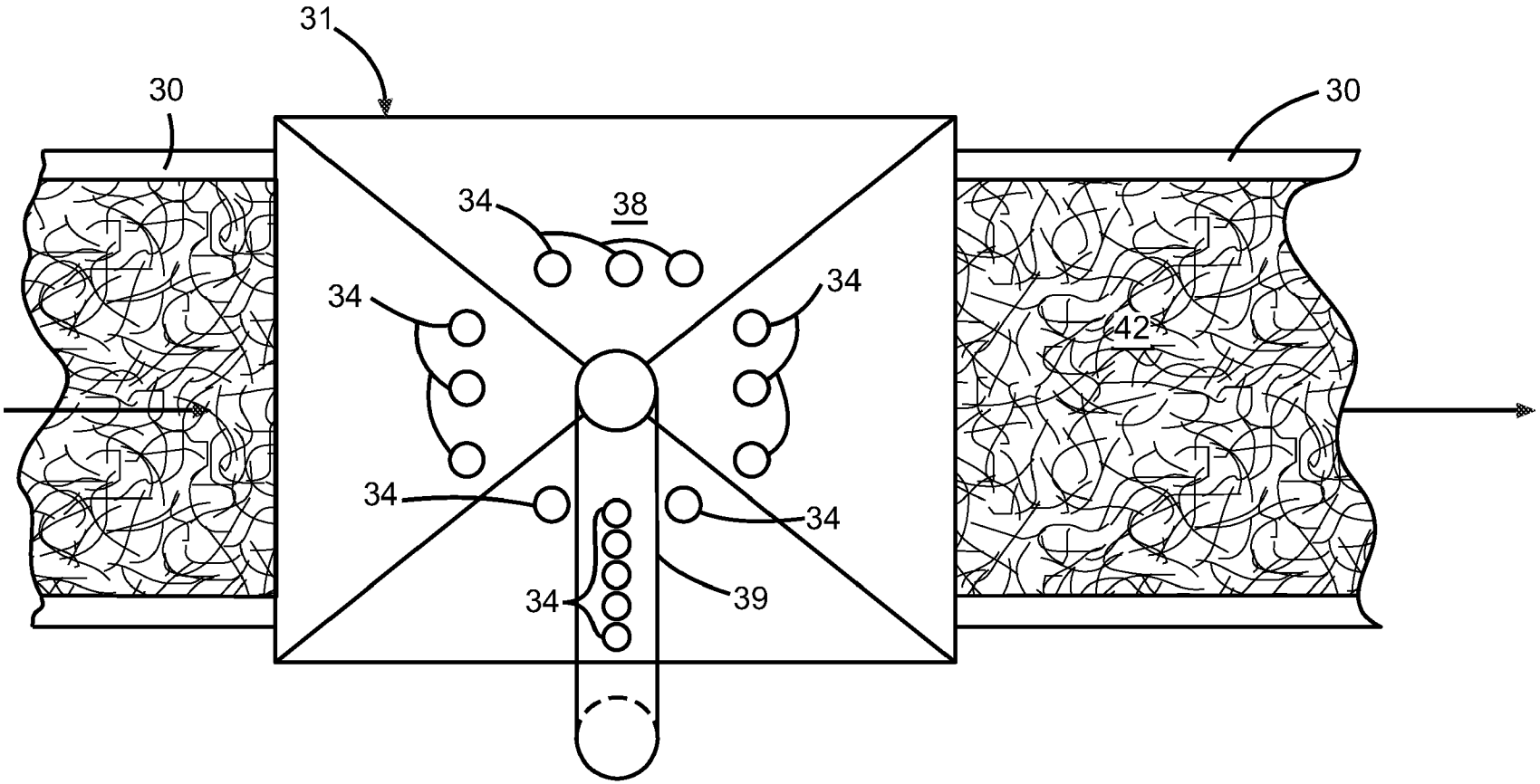
FIG. 6 is a plan view of the system shown in FIG. 5.

FIG. 5 shows a front view of the de-dusting application system 31 of the invention. In this system 31 the fibrous web, mat or blanket 20, 64 and/or 88 is pulled, or carried on a moving permeable belt 30 through the system 31 where the de-dusting agent, in very fine droplets size are applied to the fibers, chips and particles in the web, mat or blanket 20, 64 and/or 88 in the manner described above in the description of FIG. 1. The de-dusting agent(s) application system shown in FIGS. 4-6 differs from the system shown in FIG. 1 in that the atomization chamber is in the return duct 39 and/or in the portion where the return air enters first enters the upper portion of an upper hood 65 of the system 31 and further that optional distribution vanes 66 are used to produce an even distribution of the recycle air 40, or optionally fresh air 67, or any mixture of the two, into the atomization chamber 32. Any of these arrangements or locations of the atomization chamber(s) 32, here contained in the hood 41, produces the desired result. As shown in FIG. 5, any type of fan, but preferably a centrifugal fan 38 is used to pull an air suspension 33 of very fine droplets through the mat, web and/or blanket 20, 64, 88 and out of the partial vacuum chamber 36. More than one fan can be used if desired to produce the desired result where that arrangement is needed or most practical. The exhaust 40 from the fan 38 can be exhausted, partially exhausted, partly recycled to the system 31 or entirely recycled to the system 31. When entirely exhausted or partially exhausted, fresh air 67 is used as make-up air or used entirely to form the droplet suspension 33. At times it is desirable to dump some of the exhaust 40 and to use at least some fresh air as make-up air to keep the temperature of the air in the atomization chamber 32 in a desirable range. This temperature range will depend upon the de-dusting agent(s) being used, the size of the droplets, the desired amount of de-dusting agent(s) on the fibers in the finished mat, web and/or blanket and the temperature of the fibers in the web, mat and/or blanket being treated and will be within the ordinary skill of the art to determine suitable temperatures and to optimize. The number of atomizing nozzles 34, and their location, will also depend upon these just mentioned factors.

The atomizing nozzles or generators can be any device capable of converting a de-dusting agent into particles or droplets having an average diameter in the range of less than about 3 microns, typically less than 2 microns, more typically less than 1 micron and most typically less than to in the range of about 200 to about 700, 800 or 900 nanometers (nm). Typical devices most suitable for atomizing the de-dusting agent into particles or droplets of the most desired size are piezoelectric ultrasonic atomizers such as disclosed in U.S. Pat. Nos. 5,465,913, 7,090,028 and 7,129,619 and in published patent application 2008/0283048 A1, the disclosures of which are incorporated herein by reference. Depending upon the rate of the surface area of the fibers in the web, mat and/or blanket passing the atomizer chamber 32, one or a plurality of droplet or particle nozzles or generators will be used to project a stream of particles or droplets into the air suspension generating chamber 32, normally a plurality. Nanomizers™ of various types capable of generating particles or droplets of the disclosed size can also be used.

Any de-dusting agent or combination of agents can be used in the invention. Normally, the de-dusting agent(s) will be liquid, but can also be solid particles. Some suitable de-dusting agents include known de-dusting silicone compounds and/or oils, hydrocarbon oils, vegetable oils, and other known organic fluids used in the fiber industry as de-dusting agents, with hydrocarbon oils and vegetable oils being possibly the most effective, especially when added in amounts of about 0.3 wt. % to about 2.2 wt. %, based on the dry weight of the fibrous mat, web or blanket prior to the addition of the de-dusting agent(s).

Silicone containing de-dusting agents include, but are not limited to, silicone containing surface active agents including any and all silicone containing materials that includes those that have one or more hydrophobic groups and demonstrate surface active properties. Particularly preferred are silicone polymers which include alkoxylate groups such as ethylene oxide, propylene oxide, and mixtures thereof. Examples of silicone surface active agents which may be selected for use in the present composition are disclosed in U.S. patents including U.S. Pat. Nos. 5,104,647, 5,017,216, 5,145,978, 5,145,977 and world patent No. WO 94/22311, which patents are hereby incorporated herein by reference.

Some suitable hydrocarbon oils include Paraffinic process oils Catenex S 721, S 732, S 745, S 779, and Hydro-treated Paraffinic process oils Catenex T 121, T129 and T 145 available from Shell Oil company. Also, Sunpar 107, a severely solvent refined light paraffinic petroleum oil available from Sunoco, Inc. of Philadelphia, Pa., and Agri-Pure® Gold Blown vegetable oil and Experimental Blown vegetable oil (Synonyms: 186-942), both fats and glyceridic oil, vegetable, polymd, oxidized, available from Industrial Oils & Lubricants of Chicago, Ill., are suitable. In general, the amount of de-dusting agent or agents applied to the fibrous web, mat and/or blanket more typically are in the range of about 0.6 wt. % to about 0.9 wt. %, based on the weight of the dry web, mat and/or blanket. Less can be used, but some undesirable dusting of the fibrous product will occur and a greater amount can be used, but with no appreciable additional dust suppression resulting. The most typical de-dusting agents used is/are those available from Shell Oil and/or Sunoco Oil Co. having the designation Sunpar bright stock or Shell Catenex™ 779 and being a bright stock oil.

Although the air suspension generator, atomization generator 32 is depicted in the figures as being just above the fibrous web, mat and/or blanket, as is the most desirable, it is to be understood that it can be located in any location, except inside the fibrous mat, web and/or blanket, in the circulating system shown as optional in the system shown in the figures, note particularly FIG. 1.

Different embodiments employing the concept and teachings of the invention will be apparent and obvious to those of ordinary skill in this art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

What is claimed is:

1. A system for producing a fibrous mat, web and/or blanket comprising:

a) a fiber generator, b) a moving, permeable collecting belt for collecting a web of the fibers, c) an oven for removing any water or solvent from the fibrous web and d) a de-dusting agent(s) application system comprising:

i) one or more atomizers or generators for producing a stream of liquid droplets of one or more de-dusting agents, the majority of the liquid droplets having a diameter of less than about 2 microns and a mean diameter of less than about 900 nanometers, into an atomization chamber containing a moving air stream to form an air suspension of said liquid droplets, ii) an atomization chamber and iii) one or more fans for passing said air suspension through the dry fibrous mat, web and/or blanket to deposit said liquid droplets onto the surfaces of fibers in the fibrous mat, web and/or blanket to deposit the desired amount of de-dusting agent(s) in the fibrous mat, web and/or blanket.

2. The system of claim 1 wherein the majority of the liquid droplets have a mean diameter of less than about 700 nm.

3. The system of claim 2 wherein the majority of the liquid droplets have a diameter of less than about 1 micron.

4. The system of claim 3 wherein at least about 70% of the liquid droplets have a diameter of less than about 1 micron.

5. The system of claim 1 wherein the majority of the liquid droplets have a mean diameter of equal to or less than about 200 nm.

6. The system of claim 5 wherein at least about 90% of the liquid droplets have a mean diameter of equal to or less than about 200 nm.

7. The system of claim 5 wherein the majority of the liquid droplets have a diameter of less than about 1 micron.

8. The system of claim 7 wherein at least about 80% of the liquid droplets have a diameter of less than about 1 micron.

9. The system of claim 2 wherein at least about 100% of the liquid droplets have a mean diameter of less than about 700 nm.

10. The system of claim 2 further comprising one or more ducts for directing part or all of an exhaust from the one or more fans into the atomization chamber as the moving air stream.

11. The system of claim 1 wherein the atomizers or generators are adapted to produce said liquid droplets from de-dusting agent(s) including hydrocarbon oils, vegetable oils and non-organic oils.

12. The system of claim 1 further comprising one or more ducts for directing part or all of an exhaust from the one or more fans into the atomization chamber as the moving air stream.

* * * * *